US005800914A

United States Patent [19]

Shiokawa et al.

[11] Patent Number: 5,800,914

[45] Date of Patent: Sep. 1, 1998

[54] THERMAL IMAGE TRANSFER RECORDING MEDIUM

[75] Inventors: Keiichi Shiokawa; Yasumitsu Kuga, both of Numazu; Naoshi Yamamoto, Fuji, all of Japan

[73] Assignee: Ricoh Company, Ltd., Tokyo, Japan

[21] Appl. No.: 657,530

[22] Filed: Jun. 4, 1996

Related U.S. Application Data

[63] Continuation-in-part of Ser. No. 261,193, Jun. 16, 1994, abandoned.

[30] Foreign Application Priority Data

Jun. 16, 1993 [JP] Japan ..... 5-169765
Sep. 9, 1993 [JP] Japan ..... 5-248795

[51] Int. Cl.[6] ..... B41M 5/26

[52] U.S. Cl. ..... 428/323; 420/195; 420/206; 420/212; 420/484; 428/488.4; 428/497; 428/913; 428/914

[58] Field of Search ..... 428/195, 323, 428/327, 484, 488.1, 488.4, 913, 206, 212, 497

[56] References Cited

U.S. PATENT DOCUMENTS 4,880,686 11/1989 Yaegashi et al. ..... 428/488.4
5,134,019 7/1992 Shiokawa et al. .
5,179,388 1/1993 Shiokawa et al. .
5,183,697 2/1993 Ide et al. .
5,238,729 8/1993 Ide et al. .
5,250,361 10/1993 Ide et al. .
5,258,234 11/1993 Ide et al. .
5,324,585 6/1994 Akiyama et al. .
5,328,747 7/1994 Ide et al. .
5,336,548 8/1994 Shiokawa et al. .
5,409,758 4/1995 Hiyoshi et al. .
5,428,372 6/1995 Akiyama et al. .

FOREIGN PATENT DOCUMENTS 37 30 600 A1 3/1988 Germany .
42 15 893 11/1992 Germany .

*Primary Examiner*—Pamela R. Schwartz
*Attorney, Agent, or Firm*—Oblon, Spivak, McClelland, Maier & Neustadt, P.C.

[57] ABSTRACT

A thermal image transfer recording medium includes a heat resistant substrate; an intermediate layer with a voidage of 20% or less, which includes a granular thermofusible material and a thermoplastic resin, formed on the heat resistant substrate; and a thermal image transfer ink layer containing a coloring agent, formed on the intermediate layer.

11 Claims, 2 Drawing Sheets

THERMAL IMAGE TRANSFER RECORDING MEDIUM

This application is a Continuation-in-Part of application Ser. No. 08/261,193, filed on Jun. 16 1994, now abandoned.

BACKGROUND OF THE INVENTION

1. Field of the Invention

The present invention relates to a thermal image transfer recording medium, more particularly to a thermal image transfer recording medium which has excellent image fixing performance and is capable of forming clear thermal transferred images on image receiving media with varieties of surface properties, for instance, base paper, coated paper and films.

2. Discussion of Background

Thermal image transfer recording is not only used in word processors and facsimile apparatus, but also is making great contributions to the automation of recording as in FA (factory automation) and POS because of the advantages thereof over other recording methods in that the apparatus for the thermal image transfer recording is simple in the mechanism and inexpensive.

Under such circumstances, there has been a demand for a thermal image transfer recording medium capable of yielding transferred images with excellent fixing performance which are resistant to friction and scratching.

In order to meet such demand, there have been proposed a number of thermal image transfer recording media. In most of such conventional thermal image transfer recording media, it has been tried to satisfy the request for the improvement of the resistance to scratching by use of a particular resin as the binder resin component for a thermal transfer ink for the thermal image transfer recording medium. As representative examples of such a particular resin, the following resins have been proposed: Polyester resin (Japanese Laid-Open Patent Application 2-59770), epoxy resin (Japanese Laid-Open Patent Application 2-204093), and acrylic resin (Japanese Laid-Open Patent Application 2-258294).

However, when the above-mentioned resins are employed as the resin component for the thermal transfer ink, the image transfer performance obtained is not always good. Furthermore, a thermal transfer ink comprising any of the above-mentioned resins as the binder resin component therefor can only be employed for an image receiving medium with excellent surface smoothness, such as image receiving media made of a film, plastics, or synthetic paper, and cannot always be employed for an image receiving medium made of a coated paper with a base made of paper. When thermal image transfer recording is performed on such a coated paper, extremely high energy is required.

In an attempt to remove the above-mentioned shortcomings of the conventional thermal image transfer inks, a thermal image transfer recording medium has been proposed with the provision of a lubrication-imparting agent layer which comprises as the main components wax and a thermoplastic resin under a resin ink layer serving as the thermal image transfer ink layer as in Japanese Laid-Open Patent Application 2-258294.

This thermal image transfer recording medium, however, has poor image fixing performance, and is not capable of forming clear thermal transfer images on image receiving media with varieties of surface properties, for instance, base paper, coated paper and films, by the application of low thermal energy thereto.

SUMMARY OF THE INVENTION

It is therefore a first object of the present invention to provide a thermal image transfer recording medium which has excellent image fixing performance and is capable of producing transferred images with sufficient resistance to friction and scratching for use in practice.

A second object of the present invention is to provide a thermal image transfer recording medium which is capable of forming clear thermal transferred images on image receiving media with varieties of surface properties, for instance, base paper, coated paper and films, by the application of low energy thereto.

These objects of the present invention are achieved by a thermal image transfer recording medium which comprises a heat resistant substrate; an intermediate layer with a voidage of 20% or less, which comprises a granular wax component and a thermoplastic resin, formed on the heat resistant substrate; and a thermal image transfer ink layer comprising a coloring agent formed on the intermediate layer.

For the achievement of the above-mentioned objects of the present invention, the thermal transfer ink layer may further comprise a thermoplastic resin.

Alternatively, the thermoplastic resin for the thermal transfer ink layer may further comprise an acrylic copolymer prepared, with one monomer component for the copolymerization being acrylonitrile or methacrylonitrile.

Furthermore, the thermoplastic resin for the intermediate layer may be at least one resin selected from the group consisting of styrene resin and an adhesiveness-imparting resin.

Furthermore, the thermal diffusivity in the portion between (a) the free back side of the heat resistant substrate, which is opposite to the intermediate layer, and (b) the front side of the intermediate layer, which is in contact with the thermal image transfer ink layer, may be 0.015 $cm^2/s$ or more.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1(*b*) is a schematic illustration of the image transfer mechanism when the thermal image transfer recording medium shown in FIG. 1(*a*) is used.

FIG. 3(*b*) is a schematic illustration of the image transfer mechanism when the conventional thermal image transfer recording medium shown in FIG. 3(*a*) is used.

FIG. 4(*b*) is a schematic illustration of the image transfer mechanism when the conventional thermal image transfer recording medium shown in FIG. 4(*a*) is used.

DESCRIPTION OF THE PREFERRED EMBODIMENTS

With reference to the accompanying drawings, the present invention will now be explained in detail.

Figure 3A:
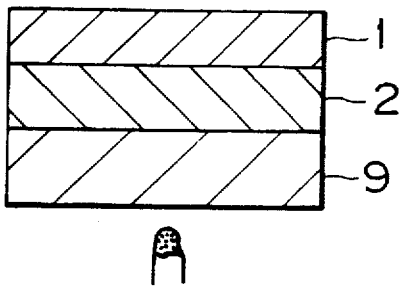
FIG. 3(*a*) is a schematic cross-sectional view of an example of a conventional thermal image transfer recording medium.
Figure 3B:
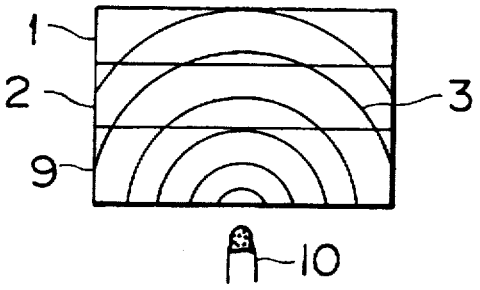
Figure 4A:
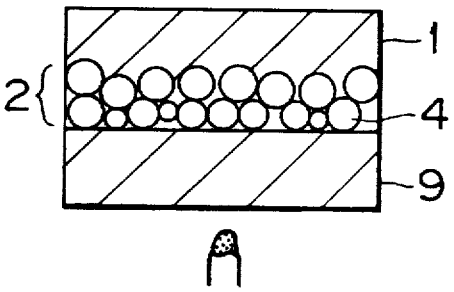
FIG. 4(*a*) is a schematic cross-sectional view of another example of a conventional thermal image transfer recording medium.
Figure 4B:
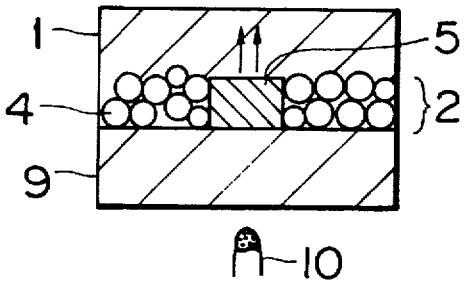

FIG. 3(*a*) and FIG. 4(*a*) respectively show the schematic cross sectional views of two examples of conventional thermal image transfer recording media. In these figures, reference numeral 1 indicates a thermal transfer ink layer; reference numeral 2, an intermediate layer; reference numeral 4, a granular thermofusible material; reference numeral 9, a heat resistant substrate; and reference numeral 10, a heat source.

Figure 1A:
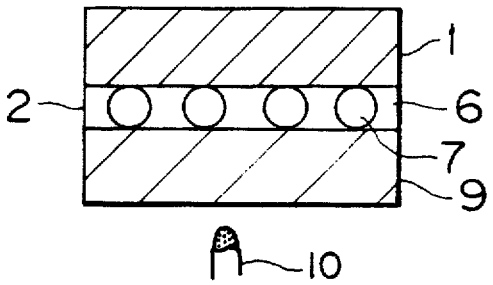
FIG. 1(*a*) is a schematic cross-sectional view of an example of a thermal image transfer recording medium of the present invention.
Figure 1B:
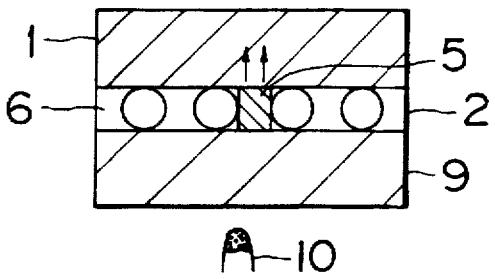
Figure 2:
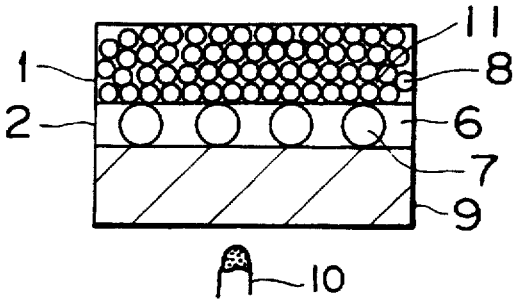
FIG. 2 is a schematic cross-sectional view of another, example of a thermal image transfer recording medium of the present invention.

FIG. 1(*a*) and FIG. 2 respectively show the schematic cross-sectional views of two examples of a thermal image transfer recording medium of the present invention. In these figures, reference numeral 6 indicates a thermoplastic resin; reference numeral 7, a granular thermofusible material; reference numeral 8, a resinous ink; and reference numeral 11, a coloring agent.

In the conventional thermal image transfer recording medium as shown in FIG. 3(*a*), in which the intermediate layer which is formed by coating a thermofusible material uniformly and continuously is provided, the heat from the heat source 10 such a thermal head (hereinafter referred to as the thermal head 10) is uniformly diffused through the recording medium, and the image transfer performance of the recording medium is improved by the presence of the intermediate layer 2. However, a gap tends to be formed between the area heated by the thermal head 10 and the image transfer area by the application of the heat thereto. In other words, it is difficult to obtain sharp images by the conventional thermal image transfer recording medium as shown in FIG. 3(*a*). Reference numeral 3 in FIG. 3(*b*) indicates the state of the thermal diffusion within the continuous layer.

On the other hand, in another conventional thermal image transfer recording medium as shown in FIG. 4(*a*), in which the intermediate layer 2 which is formed by coating a granular thermofusible material discontinuously is provided, because of the heat insulating effect produced by the presence of an air layer within the particles of the thermofusible material, the materials which constitute the intermediate layer 2 are sharply melted and the sharpness of the transferred images is improved by the gaps within the particles of the granular thermofusible material as illustrated in FIG. 4(*b*). Reference numeral 5 in FIG. 4(*b*) indicates a melted portion by the application of heat thereto. The efficiency of the heat transfer to the ink materials in the thermal image transfer ink layer, however, is significantly decreased. As a result, poorly fixed transferred images are formed.

In contrast to these conventional thermal image transfer recording media, in the thermal image transfer recording medium of the present invention as illustrated in FIG. 1(*a*), an intermediate layer portion is in such a form that the gaps between the particles of the granular thermofusible material 7 are filled with the thermoplastic resin 6, with the voidage of the intermediate layer being 20% or less, whereby transferred images with excellent fixing performance are obtained without impairing the efficient transfer of heat to the thermal image transfer ink layer.

This effect can be further improved by setting the thermal diffusivity in the portion between (a) the free back side of the heat resistant substrate 9, which is opposite to the intermediate layer 2, and (b) the front side of the intermediate layer 2, which is in contact with the thermal image transfer ink layer 1, at 0.015 $cm^2/s$ or more.

Furthermore, the thermoplastic resin 6 and the granular thermofusible material 7 employed in the intermediate layer 2 have excellent peeling-off effect, whereby this thermal image transfer recording medium is capable of forming clear and sharp thermal transfer images on image receiving media with varieties of surface properties, for instance, base paper, coated paper and films.

The term "voidage" employed with respect to the intermediate layer means the percentage of the cross section area of the air void portions formed between the particles of the materials contained in a unit area of the same cross section of the intermediate layer or in a unit area of the same surface area of the intermediate layer. The voidage can be easily determined by measuring the areas of the respective cross sections or the cross section of the air void portions and the surface of the intermediate layer by a scanning electron microscope or a transmission electron microscope.

The thermal diffusivity c an be calculated by measuring the temperature amplitude as a function of the diffusion distance, for instance, by a conventional optical current method.

In the present invention, it is preferable that the voidage of the intermediate layer be 20% or less, more preferably 10% or less, most preferably substantially zero percent, for improvement of the image fixing performance and thermosensitivity of the thermal image transfer recording medium, and also for expanding the numeral of the kinds of image receiving media that can be employed in combination with the thermal image transfer recording medium of the present invention.

Furthermore, in the thermal image transfer recording medium of the present invention as shown in FIG. 1(*a*), the advantages of the present invention can be further secured by containing the thermoplastic resin 6 in an amount of 20 to 70 wt. % of the entire weight of the intermediate layer 2.

Furthermore, when at least one of styrene resin or an adhesiveness-imparting resin is employed as the thermoplastic resin 6, an appropriate adhesion balance can be obtained between the intermediate layer and the heat resistant substrate 9, so that noise which is generated when the intermediate layer is peeled off the substrate 9 at the time of image transfer can be significantly reduced, and the hardness of the surface of transferred images can be improved, and accordingly the resistance of the transferred images to friction and scratching can also be improved.

As the material of the heat resistant substrate 9 on which the intermediate layer 2 is provided, films and paper which are conventionally employed in this field can be employed. For instance, plastic films having relatively good heat resistance, such as films made of polyester, polycarbonate, triacetyl cellulose, nylon or polyamine; cellophane, and parchment paper, are suitable for the material for the heat resistant substrate 9.

It is preferable that the heat resistant substrate 9 have a thickness in the range of 2 to 15 μm when a thermal head is employed as the heat source 10 for thermal transfer. However, when a heat source, which can selectively heat the thermal image transfer ink layer, such as a laser beam, is employed as the heat source 10 for thermal transfer, there is no particular limitation on the heat source to be employed.

When a thermal head is employed, it is preferable to provide a heat resistant protective layer on the free side of the substrate 9 with which the thermal head comes into contact, to improve the heat resistance of the substrate 9 further. The protective layer may be made of a resin, for instance, silicone resin, fluoroplastics, polyimide resin, epoxy resin, phenolic resin or melamine resin. By providing such a protective layer on the substrate 9, a substrate which cannot conventionally be used may also be used.

As the coloring agent for use in the thermal image transfer ink layer of the thermal image transfer recording medium of the present invention, there may be used any conventional coloring agents, such as carbon black, organic pigments, inorganic pigments and dyes in accordance with the desired color.

As the thermoplastic resin for use in the thermal image transfer ink layer of the thermal image transfer recording medium of the present invention, there may be used any conventional thermoplastic resins such as acrylic resin, polyester resin, polystyrene resin, ethylene-vinyl acetate copolymer resin, cellulose resin, epoxy resin, polyurethane resin, polyamide resin, polyethylene resin, and polycarbonate resin in accordance with the desired resistance of the thermal image transfer ink layer.

It is preferable that the content of such a thermoplastic resin in the thermal image transfer ink layer be in the range of 0 to 95 wt. % of the entire weight of the thermal image transfer ink layer.

The above-mentioned thermoplastic resins may be also used in combination, with the adhesiveness or fixing performance of the transferred images to an image receiving medium taken into consideration. The above-mentioned resins may be used with the modification in the form of graft copolymers.

Of a variety of thermoplastic resins, acrylonitrile- or methacrylonitrile-based copolymers are particularly preferable for use in the thermal image transfer ink layer.

Specific examples of such acrylonitrile- or methacrylonitrile-based copolymers include acrylonitrile-methyl methacrylate copolymer, acrylonitrile-methyl acrylate copolymer, acrylonitrile-ethyl methacrylate copolymer, acrylonitrile-ethyl acrylate copolymer, acrylonitrile-n-butyl methacrylate copolymer, acrylonitrile-glycidyl methacrylate copolymer, acrylonitrile-glycidyl acrylate copolymer, acrylonitrile-2-hydroxyethyl methacrylate copolymer, acrylonitrile-iso-butyl methacrylate copolymer, acrylonitrile-tert-butyl methacrylate copolymer, acrylonitrile-2-hydroxypropyl methacrylate copolymer, methacrylonitrile-methyl methacrylate copolymer, methacrylonitrile-methyl acrylate copolymer, methacrylonitrile-ethyl methacrylate copolymer, methacrylonitrile-ethyl acrylate copolymer, methacrylonitrile-n-butyl methacrylate copolymer, methacrylonitrile-glycidyl methacrylate copolymer, methacrylonitrile-glycidyl acrylate copolymer, methacrylonitrile-2-hydroxyethyl nethacrylate copolymer, methacrylonitrile-iso-butyl methacrylate copolymer, methacrylonitrile-tert-butyl methacrylate copolymer, and methacrylonitrile-2-hydroxypropyl methacrylate copolymer.

Of the above-mentioned copolymers, acrylonitrile glycidyl methacrylate copolymer, acrylonitrile-methyl methacrylate copolymer, and acrylonitrile-ethyl methacrylate copolymer are particularly suitable for use in the present invention in view of the advantages over other copolymers in that these copolymers are extremely resistant to heat, chemicals and friction, and can be easily industrially produced.

In the above-mentioned copolymers, other various vinyl monomers can be used as comonomers for the copolymers to produce terpolymers as long as the objects of the present invention can be achieved.

A specific example of such a terpolymer is a copolymer having the following formula (I):

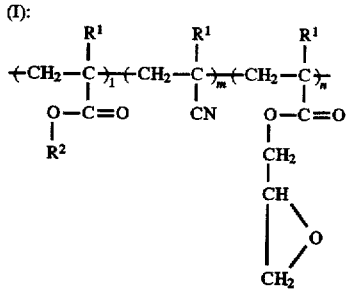

wherein $R^1$ is —H or —$CH_3$; $R^2$ is —H, —$CH_3$, —$C_2H_5$, —$C_3H_7$, —$C_4H_9$ or —$C_2H_4OH$; and 1, m, n are respectively an integer.

The functions of the respective comonomers in the above copolymer are as follows:

(Meth)acrylate: imparting thermoplasticity to the copolymer, controlling the glass transition temperature (Tg) thereof, and also imparting to the copolymer the resistance to chemicals.

(Meth)acrylonitrile: imparting to the copolymer the resistance to chemicals, mechanical strength and heat resistance.

Glycidyl (meth)acrylate: imparting adhesiveness, crosslinking properties, and heat resistance to the copolymer.

It is preferable that the composition ratio of these comonomers be as follows for securing the mechanical strength, the maintenance of the resistance to chemicals, and the avoidance of the curling of the thermal image transfer ink layer, which are sufficient for use in practice:

1:m:n (weight ratio)=(0–80):(10–70):(0–80), more preferably (10–60):(20–60):(10–60)

The molecular weight of such copolymers has an effect on the melt viscosity thereof, and the thermosensitivity of the thermal image transfer ink layer at the time of image transfer depends upon the molecular weight of the copolymers. Therefore, it is preferable that the weight-average molecular weight (hereinafter referred to as MW) and the numeral average molecular weight (hereinafter referred to as MN) of the copolymers in terms of a polystyrene conversion value by GPC (Gel Penetration Chromatography) be respectively in the range of 2,000 to 1,000,000, more preferably in the range of 3,000 to 500,000 (MW), and in the range of 1,000 to 500,000, more preferably in the range of 1,500 to 250,000 (MN).

These copolymers can be easily prepared by conventional methods. For example, the polymerization is conducted by use of a radical initiator, such as benzoyl peroxide and azobisisobutyronitrile, in an appropriate solvent at an appropriate temperature. The polymerization can also be conducted by conventional emulsion polymerization.

The thermoplastic resin employed in the thermal image transfer ink layer may be in the form of particles when providing the thermal image transfer ink layer to improve the thermosensitivity of the thermal image transfer ink layer for the accomplishment of the image formation by low thermal energy.

Such a thermal image transfer ink layer can be prepared by a conventional method. For example, the thermal image transfer ink layer can be provided by coating a thermal image transfer ink layer formation emulsion prepared by emulsion polymerization or by coating a resin dispersion liquid prepared by dispersing a resin solution in a poor solvent such as alcohols, and water. In the former method, thermoplastic resin particles with a particle size of about 0.5 μm or less can be prepared, and in the latter method, thermoplastic resin particles with a particle size in the range of 1 to 3 μm can be prepared.

Furthermore, in order to improve the resolution of the thermal image transfer of the thermal image transfer ink layer, waxes such as paraffin wax, candelilla wax, carnauba wax in the form of granules, may be added to the thermal image transfer ink layer in an amount by which the previously mentioned resistances of transferred images are not impaired.

The thickness of the thermal image transfer ink layer may be adjusted in accordance with the required thermosensitivity thereof and image density, but it is preferable that the thickness be in the range of 0.5 to 5 μm, more preferably in the range of 0.8 to 3.0 μm.

The intermediate layer for the thermal image transfer recording medium of the present invention will now be explained.

As the thermoplastic resin for use in the intermediate layer, the same thermoplastic resins as those employed in the thermal image transfer ink layer of conventional thermal image transfer recording media can be employed. Of such thermoplastic resins, styrene resin and adhesiveness-imparting resin are particularly suitable for the intermediate layer of the thermal image transfer recording medium of the present invention.

Specific examples of the styrene resin include polystyrene, styrene-α-methylstyrene copolymer, and styrene-acrylic copolymer. Of these styrene resins, preferable styrene resins are those having a softening point of 130° C. or less, and more preferable styrene resins are those having a softening point of 100° C. or less.

Specific examples of the adhesiveness-imparting resin for use in the present invention are of the following types:

Rosin type: rosin, modified rosin, partially hydrogenated rosin, polymerized rosin, rosin glycerin ester, and completely hydrogenated rosin.

Polyterpene type: α-pinene polymer, β-pinene polymer, dipenetene polymer, pentene-phenol copolymer, and α-pinene-phenol copolymer.

Hydrogenated petroleum resin type: hydrogenated $C_5$ petroleum resin, hydrogenated $C_9$ petroleum resin, and hydrogenated DCPD (i.e. dicyclopentadiene) petroleum resin.

The above-mentioned styrene resins and adhesiveness-imparting resins are added so as to fill up the gaps formed between the granular thermofusible material, so that it is preferable that these resins be prepared so as to form a uniform phase when the intermediate layer is formed by coating.

It is preferable that the above-mentioned thermoplastic resin be in an amount of 20 to 70 wt. % in terms of the amount of solid components of the entire weight of the intermediate layer.

As a granular thermofusible material for use in the intermediate layer, conventionally known thermofusible waxes can be employed. Specific examples of such thermofusible waxes include natural waxes such as beeswax, carnauba wax, spermaceti, Japan wax, candelilla wax, rice bran wax and montan wax; synthetic waxes such as paraffin wax, microcrystalline wax, oxidized wax, ozokerite, ceresin, ester wax and polyethylene wax; higher fatty acids such as margaric acid, lauric acid myristic acid, palmitic acid, stearic acid, phloionic acid and behenic acid; higher alcohols such as stearyl alcohol and behenyl alcohol; esters such as fatty acid esters of sorbitan; and amides such as stearamide and oleamide.

Of these thermofusible waxes, harder waxes are preferable for use in the intermediate layer in order to obtain transferred images having sufficiently high scratching resistance. From this point of view, in the present invention, vegetable waxes such as carnauba wax, rice bran wax, and candelilla wax are preferably employed.

It is preferable that the particle size of such thermofusible waxes be 10 μm or less when used in the intermediate layer in the present invention. When the particle size of such thermofusible waxes exceeds 10 μm, the sharpness, scratching resistance and friction resistance of the transferred images tend to be decreased.

The above-mentioned granular thermofusible waxes can be industrially produced without difficulty by conventional methods such as solvent dispersion, emulsification, and water dispersion.

An intermediate layer comprising thermofusible particles and a thermoplastic resin filling in gaps between the thermofusible particles can be prepared by dispersing the thermofusible particles and dissolving the thermoplastic resin in a liquid in which the thermofusible particles are insoluble, but in which the thermoplastic resin is soluble, to prepare a coating liquid; coating the thus prepared coating liquid on a substrate; and drying the coated coating liquid.

When wax is used as the material for the thermofusible particles, for instance, toluene and xylene can be employed as the above-mentioned liquid for dispersing wax particles.

In a representative method of forming an intermediate layer having a voidage of substantially zero, the particle size of the thermofusible particles is set at 5 μm or less, and the amount of the thermoplastic resin is set in the range of 20 to 70 wt. % of the entire weight of the intermediate layer on a dry basis.

In order to impart elasticity to the intermediate layer for increasing the close contact of the thermal image transfer recording medium with an image receiving medium, an elastic rubber material, such as isoprene rubber, butadiene rubber, ethylene propylene rubber, butyl rubber and nitrile rubber, may be added to the intermediate layer.

Furthermore, in order to increase the adhesiveness of the intermediate layer to the substrate and/or the thermal image transfer ink layer, a resin such as ethylene-vinyl acetate copolymer, and ethylene-ethyl acrylate copolymer, may be added to the intermediate layer, or an adhesive layer may be provided between the substrate and the intermediate layer.

Furthermore, in order to improve the resistance to abrasion and the resistance to chemicals of the transferred images, and also to improve the thermal transfer performance and the image resolution of the thermal image transfer recording medium, finely-divided inorganic or organic particles or lubricants may be added to the intermediate layer. As such finely-divided inorganic and organic particles, and lubricants, conventionally employed ones can be used. Of these particles and lubricants, finely-divided tetrafluoro-ethylene resin particles are particularly preferable for use in the intermediate layer in the present invention.

It is preferable that the average particle size of these finely-divided particles and lubricants, measured by the optical transmission method, be not more than 5 μm, more preferably in the range of 0.1 to 4.0 μm, for avoiding the reduction of the resolution for image formation, peeling off of the thermal image transfer ink layer, and the reduction of the sharpness of the transferred images.

It is preferable that the amount of the finely-divided tetrafluoroethylene resin particles be in the range of 1 to 40 wt. %, more preferably in the range of 5 to 20 wt. %, of the entire weight of the intermediate layer, to form the intermediate layer. When the amount exceeds 40 wt. %, the problem of the peeling of the intermediate layer away from the substrate may be caused.

The thickness of the intermediate layer in terms of the deposition of the composition materials for the intermediate layer on the substrate may be appropriately adjusted in accordance with the image receiving performance of the image receiving medium to be used in combination with the thermal image transfer recording medium. However, it is preferable that the thickness of the intermediate layer be in the range of 0.5 $g/m^2$ to 2 $g/m^2$ in terms of the above-mentioned deposition. This is because when the thickness is less than 0.5 $g/m^2$, the image formation performance tends to be lowered when an image receiving medium with low surface smoothness is used, while when the thickness exceeds 2 $g/m^2$, the previously mentioned thermal diffusivity in the portion between (a) the free back side of the heat resistant substrate and (b) the front side of the intermediate layer tends to excessively increase, the adhesion of the ink layer to the substrate tends to be decreased, and the transferred images to become susceptible to scratching.

Other features of this invention will become apparent in the course of the following description of exemplary embodiments, which are give for illustration of the invention and are not intended to be limiting thereof.

EXAMPLES 1 TO 12 AND COMPARATIVE EXAMPLES 1 TO 6

(1) Preparation of Intermediate Layer Coating Liquids

Intermediate layer coating liquids were prepared in accordance with the formulations as shown in the following TABLE 1, in which each of intermediate layer coating liquids A to I contains a granular thermofusible wax in a dispersed state, and intermediate layer coating liquid J contains a thermofusible wax in a melted state:

TABLE 1

| Intermediate Layer Coating Liquid | Thermofusible Wax Component | Thermoplastic Resin Component (Melting Point or Softening Point) | Solvent |
|---|---|---|---|
| A | Carnauba Wax: 5 wt. % | Hydrogenated Petroleum Resin (Trademark "Arkon P-70" made by Arakawa Chemical Industries, Ltd.) (70° C.): 5 wt. % | Toluene: 90 wt. % |
| B | Carnauba Wax: 5 wt. % | Hydrogenated Petroleum Resin (Trademark "Arkon P-130" made by Arakawa Chemical Industries, Ltd.) (130° C.): 5 wt. % | Toluene: 90 wt. % |
| C | Carnauba Wax: 5 wt. % | Hydrogenated Petroleum Resin (TONEX "Eacorets" 1271) (66–76° C.): 5 wt. % | Toluene: 90 wt. % |
| D | Carnauba Wax: 5 wt. % | Low-molecular-weight Styrene Resin (Trademark "HIMER SB75" made by Sanyo Chemical Industries, Ltd.) (75° C.): 5 wt. % | Toluene: 90 wt. % |
| E | Carnauba Wax: 5 wt. % | Styrene - Acrylic Copolymer (Trademark "HIMER SBM100" made by Sanyo Chemical Industries, Ltd.) (100° C.): 5 wt. % | Toluene: 90 wt. % |
| F | Carnauba Wax: 5 wt. % | Ethylene - Vinyl acetate Copolymer (M1-400, VAc-28%): 5 wt. % | Toluene: 90 wt. % |
| G | Carnauba Wax: 10 wt. % | — | Toluene: 90 wt. % |
| H | Carnauba Wax: 9 wt. % | Hydrogenated Petroleum Resin (Trademark "Arkon P-70" made by Arakawa Chemical Industries, Ltd.) (70° C.): 1 wt. % | Toluene: 90 wt. % |
| I | Carnauba Wax: 1 wt. % | Hydrogenated Petroleum Resin (Trademark "Arkon P-70" made by Arakawa Chemical Industries, Ltd.) (70° C.): 9 wt. % | Toluene: 90 wt. % |
| J | Carnauba Wax: 80 wt. % | Hydrogenated Petroleum Resin (Trademark "Arkon P-70" made by Arakawa Chemical Industries, Ltd.) (70° C.): 20 wt. % | Hot Melt |

(2) Preparation of Thermal Image Transfer Ink Layer Coating Liquids

Thermal image transfer ink layer coating liquids were prepared in accordance with the formulations as shown in the following TABLE 2:

TABLE 2

| Thermal Image Transfer Ink Layer Coating Liquid | Binder Resin | Coloring Agent | Solvent |
|---|---|---|---|
| 1 | Acrylonitrile - methyl methacrylate-glycidyl methacrylare copolymer (MW = 6,400, MN = 3,600) Content of Solid Component: 16 wt. % | Carbon Black: 4 wt. % | Methyl ethyl ketone: 80 wt. % |
| 2 | Acrylonitrile - methyl methacrylate-glycidyl methacrylate copolymer emulsion (MW = 30,000, MN = 15,000) Content of Solid Component: 16 wt. % Average Particle Size: 0.16 μm | Carbon Black dispersed in water: Content of Solid Component: 4 wt. % | Water: 80 wt. % |
| 3 | Saturated polyester resin (Tg = 67° C.) Content of Solid Component: 16 wt. % | Carbon Black: 4 wt. % | Methyl ethyl ketone: 80 wt. % |

One of the intermediate layer coating liquids shown in one TABLE 1 and one of the thermal image transfer ink layer coating liquids shown in TABLE 2 were successively coated by use of a bar coater in such a combination as shown in TABLE 3 and dried on the front side of a PET film with a thickness of about 4.5 μm, with the free back side thereof of being subjected to heat resistant and lubricating coating, whereby thermal image transfer recording media No. 1 to No. 12 in Examples 1 to 12 of the present invention, and comparative thermal image transfer recording media No. 1 to No. 6 in Comparative Examples 1 to 6 were fabricated. In all of these thermal image transfer recording media, the thickness of each intermediate layer was about 1.0 g/m$^2$ and the thickness of each thermal image transfer ink layer was about 2 μm.

TABLE 3

| | Intermediate Layer Coating Liquid | Thermal Image Transfer Ink Layer Coating Liquid |
|---|---|---|
| Ex. No. | | |
| 1 | A | 1 |
| 2 | A | 2 |
| 3 | A | 3 |
| 4 | B | 2 |
| 5 | C | 2 |
| 6 | D | 1 |
| 7 | D | 2 |
| 8 | D | 3 |
| 9 | E | 2 |
| 10 | F | 2 |
| 11 | H | 2 |
| 12 | I | 2 |
| Comp. No. | | |
| 1 | G | 1 |
| 2 | G | 2 |
| 3 | G | 3 |
| 4 | J | 1 |
| 5 | J | 2 |
| 6 | J | 3 |

The thermal image transfer recording media No. 1 to No. 12 prepared in Examples 1 to 12 of the present invention, and comparative thermal image transfer recording media No. 1 to No. 6 prepared in Comparative Examples 1 to 6 were subjected to a thermal printing test by incorporating each of the above thermal image transfer recording media in a label printer provided with a line thermal head under the following printing conditions:

Thermal head: Dot density 8 lines/mm

Printing speed: 125 mm/sec

Platen Pressure: 200 gf/cm

Printing Pattern: COED 39 Parallel Bar Codes

Narrow Width: 2 dots

Wide Width: 6 dots

Image receiving sheets:

Commercially available art paper label with a Bekk's smoothness of 2000 seconds, White PET label, and Cast Coat Label with a Bekk's smoothness of 2400 seconds.

The transferred printed images were evaluated with respect to the following evaluation items:

Thermosensitivity Bar code readability (%) by Bar Code Laser Checker (1) Image sharpness Visual inspection (5 ranks, with rank 5 being best, and rank 1 worst, and the image sharpness increasing from rank 2 toward rank 4).

(2) Resistance to friction

Transferred images were subjected to 50-time reciprocal frictions by use of a corrugated cardboard with the application of a load of 1 kg/cm$^2$ thereto.

(3) Resistance to Scratching

Transferred images were subjected to 30-time reciprocal scratching by use of an edge of a commercially available sharp pencil to see the peeling off of the transferred images from the image receiving sheet (5 evaluation ranks, with rank 5 indicating no peeling, and rank 1 indicating complete peeling, and the peeling degree decreasing from rank 2 toward rank 4).

(4) Thermal Diffusivity

Intermediate layer coated samples with a size of 5 mm×10 mm, with a light receiving side thereof being subjected to carbon spraying, were subjected to the measurement of the thermal diffusivity thereof by a thermal constant measurement apparatus based on an optical alternate current method (Trademark "PIT-RI" made by Kyowa Kaimen Kagaku Co., Ltd.), with the measuring frequency being set at 2 Hz.

(5) Voidage

An adhesive tape was applied to the above-mentioned samples and was then peeled away from the intermediate layer, and the adhesive tape peeled off the intermediate layer was inspected by use of a commercially available scanning electron microscope made by Hitachi, Ltd. with a voltage of 18 kV, and magnifications of 500 to 2000, and the inspected area of the adhesive tape was photographed to measure the voidage of the intermediate layer.

TABLE 4

| | Evaluation Items | | | | | | | | | |
|---|---|---|---|---|---|---|---|---|---|---|
| | Image Fixing Properties | | Thermosensitivity (13 mJ/mm²) | | | Thermosensitivity (18 mJ/mm²) | | | | |
| | Resistance | | Readability (%) | | | Readability (%) | | | Voidage (%) | |
| | to Friction (100° C.) | Resistance to scratching | Art Paper | Cast Coat Paper | White PET | Art Paper | Cast Coat Paper | White PET | of Intermediate Layer | Thermal Diffusivity (cm²/s) |
| Ex. No. | | | | | | | | | | |
| 1 | 5 | 5 | 60 | 82 | 100 | 75 | 100 | 100 | 0 | 0.0180 |
| 2 | 5 | 5 | 60 | 92 | 100 | 80 | 100 | 100 | 0 | 0.0180 |
| 3 | 5 | 5 | 40 | 70 | 92 | 66 | 92 | 100 | 0 | 0.0180 |
| 4 | 5 | 5 | 76 | 92 | 100 | 92 | 100 | 100 | 0 | 0.0190 |
| 5 | 5 | 5 | 80 | 100 | 100 | 100 | 100 | 100 | 0 | 0.0170 |
| 6 | 5 | 5 | 54 | 80 | 92 | 60 | 88 | 100 | 0 | 0.0170 |
| 7 | 5 | 5 | 86 | 100 | 100 | 92 | 100 | 100 | 0 | 0.0170 |
| 8 | 5 | 5 | 86 | 100 | 100 | 100 | 100 | 100 | 0 | 0.0170 |
| 9 | 5 | 5 | 86 | 100 | 100 | 100 | 100 | 100 | 0 | 0.0180 |
| 10 | 5 | 5 | 92 | 100 | 100 | 100 | 100 | 100 | 0 | 0.0180 |
| 11 | 5 | 4 | 44 | 70 | 88 | 60 | 92 | 100 | 16 | 0.0150 |
| 12 | 5 | 4 | 76 | 88 | 100 | 90 | 100 | 100 | 0 | 0.0200 |
| Comp. Ex. No. | | | | | | | | | | |
| 1 | 5 | 5 | 30 | 66 | 70 | 52 | 80 | 92 | 34 | 0.0112 |
| 2 | 5 | 2 | 0 | 0 | 86 | 52 | 66 | 92 | 34 | 0.0112 |
| 3 | 4 | 2 | 0 | 0 | 80 | 40 | 80 | 100 | 34 | 0.0112 |
| 4 | 4 | 1 | 0 | 0 | 92 | 72 | 72 | 100 | 0 | 0.0180 |
| 5 | 4 | 2 | 50 | 72 | 88 | 66 | 72 | 100 | 0 | 0.0180 |
| 6 | 4 | 1 | 60 | 66 | 100 | 72 | 80 | 100 | 0 | 0.0180 |

What is claimed is:

1. A thermal image transfer recording medium comprising:

a heat resistant substrate;

an intermediate layer having a voidage of substantially zero, which comprises wax particles and a thermoplastic resin, formed on said heat resistant substrate, said thermoplastic resin filling in gaps between wax particles when the intermediate layer is formed on the substrate; and a thermal image transfer ink layer comprising a coloring agent, formed on said intermediate layer, wherein the thermal image transfer ink layer is the only ink-containing layer.

2. The thermal image transfer recording medium as claimed in claim 1, wherein said thermal transfer ink layer further comprise a thermoplastic resin.

3. The thermal image transfer recording medium as claimed in claim 2, wherein said thermoplastic resin for said thermal transfer ink layer comprises an acrylic copolymer prepared with one monomer component for the copolymerization being acrylonitrile or methacrylonitrile.

4. The thermal image transfer recording medium as claimed in claim 1, wherein the thermal diffusivity in the portion between (a) the back side of said heat resistant substrate, which is opposite to said intermediate layer, and (b) the front side of said intermediate layer, which is in contact with said thermal ink layer, is 0.015 cm²/s or more.

5. The thermal image transfer recording medium as claimed in claim 1, wherein said wax has a particle size of 10 μm or less and said thermoplastic resin is at least one of a styrene resin and an adhesiveness-imparting resin selected from the group consisting of a rosin, a polyterpene and a hydrogenated petroleum.

6. The thermal image transfer recording medium as claimed in claim 5, wherein said styrene resin is a member selected from the group consisting of polystyrene, styrene-α-methylstyrene copolymer and styrene/acrylic copolymer, said styrene resins having a softening point of 130° C. or less.

7. The thermal image transfer recording medium as claimed in claim 5, wherein said rosin is rosin, modified rosin, partially hydrogenated rosin, polymerized rosin, rosin glycerin ester or a completely hydrogenated rosin.

8. The thermal image transfer recording medium as claimed in claim 5, wherein said polyterpene is α-pinene polymer, β-pinene polymer, dipentene polymer, pentene-phenol copolymer or α-pinene-phenol copolymer.

9. The thermal image transfer recording medium as claimed in claim 5, wherein said hydrogenated petroleum resin is hydrogenated $C_5$ petroleum resin, hydrogenated $C_9$ petroleum resin or hydrogenated DCPD petroleum resin.

10. The thermal image transfer recording medium as claimed in claim 1, wherein the amount of said thermoplastic resin in said intermediate layer ranges from 20 to 70 wt. % of the amount of solid components in the intermediate layer.

11. The thermal image transfer recording medium of claim 1, wherein the intermediate layer is prepared by dispersing the wax particles and dissolving the thermoplastic resin in a liquid in which the wax is insoluble and the thermoplastic resin is soluble, thereby preparing a coating liquid; coating the coating liquid on the substrate; and drying the coating liquid.

* * * * *

UNITED STATES PATENT AND TRADEMARK OFFICE

CERTIFICATE OF CORRECTION

PATENT NO. : 5,800,914

DATED : SEPTEMBER 1, 1998

INVENTOR(S): KEIICHI SHIOKAWA ET AL

It is certified that an error appears in the above-identified patent and that said Letters Patent is hereby corrected as shown below:

Column 2, line 53, "another," should read --another--.

Column 4, line 18, "c an" should read --can--.

Column 5, line 51, "nethacrylate" should read --methacrylate--.

Column 11, line 26, delete "of".

Column 12, line 34, "Thermosensitivity" should read --Thermosensitivity:--.

Column 13, line 50, "comprise" should read --comprises--.

Signed and Sealed this

Nineteenth Day of October, 1999

*Attest:*

*Attesting Officer*

Q. TODD DICKINSON

*Acting Commissioner of Patents and Trademarks*